US006303003B1

(12) United States Patent
Webster

(10) Patent No.: US 6,303,003 B1
(45) Date of Patent: Oct. 16, 2001

(54) METHOD AND APPARATUS FOR DRYING A MOIST WEB

(76) Inventor: David R. Webster, 32 Forden Ave., Westmount, QC (CA), H3Y 2Y8

( * ) Notice: Subject to any disclaimer, the term of this patent is extended or adjusted under 35 U.S.C. 154(b) by 0 days.

(21) Appl. No.: 09/255,274

(22) Filed: Feb. 23, 1999

(30) Foreign Application Priority Data

Feb. 24, 1998 (CA) ..... 2230326

(51) Int. Cl.[7] ..... D21F 5/00; D21F 1/04; D21F 1/60; D06F 58/00

(52) U.S. Cl. ..... 162/290; 162/308; 162/318; 162/357; 34/116; 34/114; 34/115

(58) Field of Search ..... 162/207, 206, 162/274, 275, 290, 226, 308, 208, 217, 318, 357; 34/116, 502, 452, 456, 114, 115, 499, 108

(56) References Cited

U.S. PATENT DOCUMENTS

| | | | | |
|---|---|---|---|---|
| Re. 28,459 | * | 7/1975 | Cole et al. | 34/6 |
| 1,767,889 | | 6/1930 | Jurgensen . | |
| 2,091,805 | | 8/1937 | Chuse . | |
| 2,718,710 | | 9/1955 | Spooner . | |
| 2,896,336 | | 7/1959 | Shoumatoff . | |
| 4,247,990 | * | 2/1981 | Ohls et al. | 34/23 |

FOREIGN PATENT DOCUMENTS

| | | |
|---|---|---|
| 237426 | 1/1924 | (CA) . |
| 270607 | 5/1927 | (CA) . |

OTHER PUBLICATIONS

Article from the Pulp and Paper Magazine of Canada, Nov.1/68, pp. 55 & 56—"The Papridryer—1. The Basic Concept and Pilot Plant Results"—Burgess, B.W. et al.
Article from the Pulp and Paper Magazine of Canada, Jun. 1961, pp. T–303–309—"The Drying of Web Materials"—Burgess, B.W.

* cited by examiner

*Primary Examiner*—Stanley S. Silverman
*Assistant Examiner*—Dionne A. Walls
(74) *Attorney, Agent, or Firm*—Diller, Ramik & Wig

(57) ABSTRACT

A method and an apparatus for continuously drawing superheated vapor through a moist web as the same is being formed and pressed at a porous peripheral surface of a rotatable hollow cylinder, thereby allowing to have web drying in a compact apparatus permitting recycling of heat. The extracted moisture is transformed in superheated vapor and again used in the drying of incoming web.

11 Claims, 2 Drawing Sheets

35
34
32
31
C
33
28
30
21
17
27
42
16
16b
37
14
15
22
39
16c
3
29
41
23
2
16a
6
1
5
18
40
12
43
17
17
36
4
9
24
19
10
20
11
9
7
13
8

METHOD AND APPARATUS FOR DRYING A MOIST WEB

BACKGROUND OF THE INVENTION

1. Field of the Invention

The present invention relates to paper making and, more particularly, pertains to a new method and apparatus suitable for drying a paper web.

2. Description of the Prior Art

Current industrial practice is to manufacture paper by successively forming pressing and drying a moist fibrous web. This process is characterized by a relatively high energy consumption which accounts for much of the capital and operating cost in papermaking.

One problem resides in the fact that known suction rolls shed vacuum at each turn. For a sheet as porous as newsprint, for example, the air volume shed from drill holes defined in the peripheral surface of the suction roll is about equal to the air drawn through sheet pores. Therefore, half the vacuum pump energy is lost.

A second problem is a discharge of the vacuum pumped, to the atmosphere, thereby wasting the heat of vapor compression.

A third problem is that known suction roll have a centrifugal throw of moisture toward the sheet, at the sheet exit from the roll, undoing some drying just done.

A fourth problem is moisture removal by intermittent forces, including foil pulses, suction and press pulses, heat pulses, each force followed by a lapse of drying force, i.e. ineffective travel. Moreover, surface tension and capillary action let moisture migrate backward, a type of rewetting which undoes drying just done.

A fifth problem occurs during sheet transfers, disturbing fiber bonds and sheet dimensions because the sheet is damp and weak.

A sixth problem is a need to synchronize speeds between machine sections requiring controls which are costly to buy and maintain.

Another problem is the loss of drying heat to the atmosphere thereby wasting fuel and investment in a steam plant.

SUMMARY OF THE INVENTION

It is therefore an aim of the present invention to provide an improved drying process and apparatus which reduces the energy required to make paper.

Therefore, in accordance with the present invention there is provided a method comprising the steps of: delivering a continuous web of fibrous, moist material to a porous conveying surface; drying the web by continuously drawing superheated vapor through the web as the paper is being formed and pressed; and removing the web as dried paper from the porous conveying surface.

In accordance with a further general aspect of the present invention, there is provided a process for drying a moist web of paper in a papermaking machine of the type having a porous flexible endless conveying member in driving engagement with a porous peripheral surface of a hollow cylinder mounted for rotation about a main axis thereof, comprising the steps of applying a vacuum outside a portion of the porous peripheral surface of the hollow cylinder which is free from engagement with the porous flexible endless conveying member so as to cause a flow of moisture from the web, through the porous flexible endless conveying member and the porous peripheral surface, to a source of vacuum, compressing a vapor portion of the moisture drawn from the web such as to form a mixture of condensate and saturated vapor, expanding the saturated vapor to form superheated vapor, and recirculating the superheated vapor in a substantially closed air impervious system to be used again in the drying of web.

An apparatus for making paper in accordance with the present invention comprises a porous endless conveying member in drive engagement with a porous peripheral surface of a hollow cylinder mounted for rotation about a main axis thereof, and a drying medium circulating system for uninterruptedly drawing moisture from the web. The drying medium circulating system comprises a vacuum hooded section disposed for collecting the moisture at a portion of the porous peripheral surface of the hollow cylinder which is free from engagement with the porous endless conveying member.

According to a more specific construction of the present invention, pressing means are provided for compressing the web against the porous peripheral surface of the hollow cylinder as the web is conveyed thereover by the porous endless conveying member.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
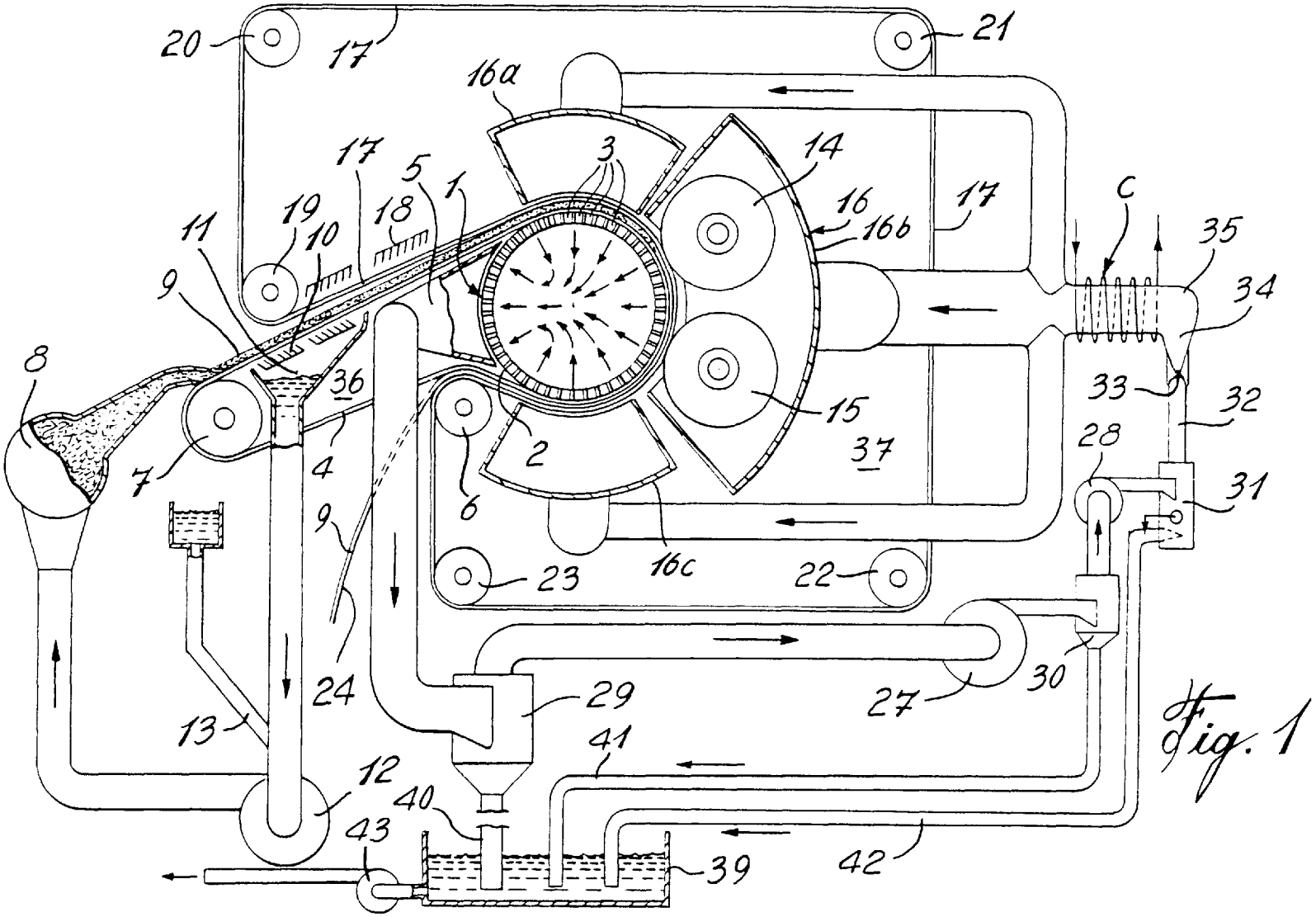
FIG. 1 is a schematic elevational view of a papermaking apparatus in accordance with the present invention.

Referring to the drawings, an apparatus suitable for making paper in accordance with the present invention comprises in combination, a rotatable hollow suction roll 1 with closed ends and with a porous peripheral surface 2 having holes 3 drilled therethrough. About two-thirds of the peripheral surface 2 of the suction roll 1 is covered by a portion of an endless porous belt 4 while the remaining third of the peripheral surface 2 is covered by an external vacuum box 5. The suction roll 1 is mounted for rotation about a central axis thereof.

The endless porous belt 4 passes over a roll 7 which may be connected to a motor (not shown) for driving the belt 4, thereby causing the suction roll 1 to revolve about its central axis. The suction roll 1, the roll 7 and a third roll 6 disposed outside of the loop formed by the endless porous belt 4 define a return circuit 36 along which the endless porous belt 4 is driven. It is understood that belt 4 may be engaged with any suitable number of rolls. As seen in FIG. 1, the vacuum box 5 is disposed within the return circuit 36 and is spaced therefrom.

Porous suction roll 1 may have a peripheral surface 2 other than drilled, such as a so-called honeycomb construction. A roll with drilled holes is however preferred for roll strength as a press.

A headbox 8 has a delivery of a stock ribbon 9 to the endless belt 4. Optional forming foils 10 are arranged to drain into tray 11 which feeds fan pump 12 in a typical manner. The impeller pump 12 discharges the stock of material supplied through the conduit 13 and the drain liquid received in tray 11 to the headbox 8 in a typical way. Stock cleaners and screens (not shown) may be provided, as is well known in the art. A drainage circuit therefore may be typical at the wet end.

According to the illustrated embodiment, a pair of rotatable press rolls 14 and 15 are disposed at the peripheral surface 2 of suction roll 1 within a hood 16 in order to have hot pressing. However, only one or more press rolls could be provided. Heat at hood 16 weakens surface tension of moisture in the fibrous ribbon 9 thereby speeding moisture removal.

An optional outer porous belt 17 may be placed in cooperation with belt 4 to make a stock ribbon entry near foils 10, similar to a gap former. Outer belt 17 may have forming foils 18 in a typical arrangement to help form a sheet from ribbon 9 at the ribbon approach to the suction roll 1.

Outer belt 17 may cooperate with belt 4 around the two-thirds of peripheral surface 2 of the suction roll 1 after which belt 17 has a return circuit 37, remote from return circuit 36 of belt 4, back to the entering stock ribbon 9. Whereas suction roll 1 is inside the run of belt 4, suction roll 1 is outside the run of belt 17, whereby endless belt 17 is herein referred to as an outside belt.

The return circuit 37 of belt 17 may be supported on any convenient number of rolls, six being shown, viz. 19, 20, 21, 22, 23 and 6, the latter being in common with belt 4. It is understood that, in operation, the outside belt 17 is driven at the same speed as that of the porous belt 4 by any suitable means. Ribbon 9 has an exit as a dried sheet 24 at roll 6, being the divergence and the start of the return circuits 36 and 37 of belt 4 and belt 17.

Variations on such return circuits would be evident to artisans.

The suction roll 1 has the hood 16 in sliding seal contact therewith. Hood 16 may be in sections, such as section 16*a* at forming, section 16*b* at pressing and section 16*c* at drying. A positive pressure is preferred in hood 16, urging ribbon 9 against belt 4, augmenting suction force at ribbon 9 bottom surface. Thereby, a combination of positive pressure at the top surface of ribbon 9 and a negative pressure at the bottom surface, together urge moisture through the sheet thickness. Furthermore, by keeping the drill holes 3 of the suction roll 1 evacuated a full turn, the suction roll 1 is prevented from shedding vacuum at each turn.

This prolonged and sustained differential pressure, through the sheet thickness, with superheated vapor rather than air as a moisture remover at ribbon 9 enhance the overall drying operation thereof.

Another advantage of the present invention is the small size of the apparatus which allows for recycling of heat.

Vacuum box 5 communicates with a vacuum pump 27. Preferably a blower-type pump, in order to avoid having seal water added to the heat cycle and in order to compress vapor to relatively high temperatures.

According to the embodiment illustrated in FIG. 1, the vacuum pump 27 is used to compress vapor to atmospheric pressure and a second pump 28, disposed downstream of pump 27, act as a second compressing stage to further compress the vapor to a preferred two atmospheres gage. An artisan may choose to combine pumps 27 and 28 into a multi stage pump with atmospheric pressure reached inside one of the stages. A multi stage pump may have at least one drainage outlet intermediate in the stages.

First and second separators 29 and 30 are respectively disposed upstream of the vacuum pump 27 and between vacuum pumps 27 and 28 to drain liquid from the mixture of liquid and saturated vapor flowing therethrough.

The vacuum pumps 27 and 28 are arranged as heat pumps with vapor compression at about two atmospheres gage raising the saturated vapor to about 275 deg. F. (135 deg. C.). Energy for the return part of the heat cycle is applied at pumps 27 and 28. In contrast, prior art has energy for drying applied at a steam plant, the vapor from drying being mostly discarded.

A third separator 31, located downstream of pump 28, discharges saturated vapor 32 at a preferred two atmospheres gage pressure corresponding to 275 deg. F. (135 deg. C.) A throttling valve 33 allows adiabatic expansion of the saturated vapor 32 to a preferred approximately one-third of an atmospheric pressure, corresponding to 228 deg. F. (108 deg. C.), as superheated vapor 34 entering hood 16. Heat losses from radiation would be well known to the man skilled in the art.

An appropriate system of pipes 35 directs the vapor 34 to at least one hood section 16*a*, 16*b* and 16*c*. These hood sections 16*a*, 16*b* and 16*c* are fitted to suction roll 1 with sliding seals (not shown) in order to have a slight positive pressure such as one-third of an atmosphere in the hood sections 16*a*, 16*b* and 16*c*. The vapor is isolated from the atmosphere. Indeed, the vapor is confined in piping and hood 16. The energy is exchanged between liquid phase and vapor phase and, back again, in a heat recycle which is airless except for some leakage.

These changes of state between liquid and vapor allow having compact apparatus, in a small space, helped by the forming, pressing and drying being at a single surface with a sustained pressure to force heat and moisture through the hot sheet.

The air of prior art is replaced in this invention with superheated vapor in order to have moisture absorbency in a small space.

As seen in FIG. 1, a heating coil C may be provided to further increase the temperature of the vapor 34 passing through the system of pipes 35.

As seen in FIG. 1, the cool liquid removed at the first separator 29, the warm liquid removed at the second separator 30 and the hot liquid removed at the separator 31 are discharged into a liquid container 39 via respective outlet conduits 40, 41 and 42. A pump 43 is provided to direct the drain liquid from the liquid container 39 to the source of ribbon 9.

In operation, moisture is moved from the top to the bottom of ribbon 9, through its thickness, by means of a sustained and uninterrupted force throughout the forming, pressing and drying while the ribbon 9 is free from flexing and tension thereby to enhance sheet quality. More specifically, in operation, the fan pump 12 is operated to continually discharge the ribbon 9 of fibrous moist material to the porous belt 4 via the headbox 8. The porous belt 4 is driven to convey the ribbon 9 supported thereon to the stock ribbon entry defined by belts 4 and 17. A first portion of the liquid contained in the ribbon 9 is removed from the ribbon 9 as the same passes through the forming foils 10. The separated liquid is received in tray 11 and then returned to the incoming ribbon 9.

As the ribbon 9 is conveyed around the suction roll 1, the vacuum pumps 27 and 28 are operated to draw moisture from the ribbon 9 through the porous belt 4 and the peripheral surface 2 of the suction roll 1. The extracted mixture of liquid and vapor is directed from the inside of the suction roll 1 through the external vacuum box 5 and the separator 29, wherein the liquid is returned to the incoming ribbon 9. The vapor exiting the separator 29 is drawn into the pump 27 wherein it is compressed such as to form a mixture of condensate and saturated vapor at a raised pressure and temperature. The condensate leaving the pump 27 is returned to the incoming ribbon 9 via the second separator 30. The saturated vapor drawn from the second separator 30 by the pump 28 is further compressed to form a mixture of condensate and saturated vapor at a raised pressure and temperature.

The condensate flowing from the pump 28 is returned to the incoming ribbon 9 via the third separator 31. As to the compressed saturated vapor flowing out of the pump 28, it is expended such as to form superheated vapor which is delivered into the hood 16 surrounding the suction roll 1, thereby forming a closed heat cycle.

As the ribbon 9 passes between the suction roll 1 and the press rolls 14 and 15, pressure is applied to the ribbon 9, thereby pressing moisture from inside the fibers thereof.

Accordingly, at its exit from the apparatus, i.e. at roll 6, the ribbon 9 is in the form of a dried sheet 24.

Figure 2:
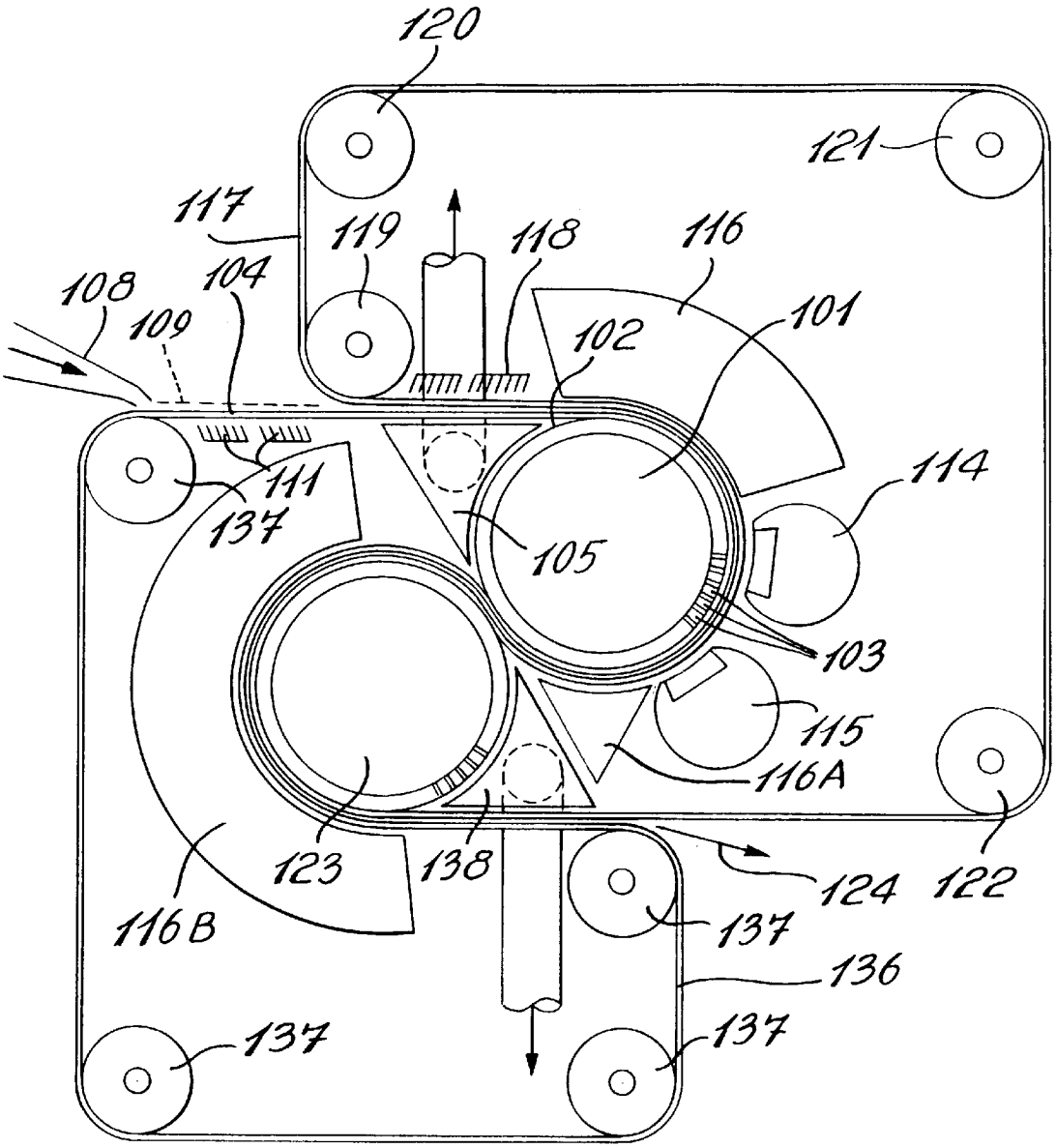
FIG. 2 is a schematic enlarged elevational view of a portion of a papermaking apparatus in accordance with a second embodiment of the present invention.

Referring now to FIG. 2, a second embodiment of the present invention, comprising two suction rolls in series, will be described hereinafter. It is noted that corresponding parts of the apparatus of FIG. 1 have similar reference numerals in FIG. 2, except being in the hundreds.

Accordingly, the apparatus of FIG. 2 includes a hollow suction roll 101 having a peripheral porous surface 102 defining a plurality of holes 103. An endless belt 104 is engaged with the suction roll 101 and passes over a certain number of rolls 137 disposed to support the belt 104 along an appropriate return circuit 136. A portion of the suction roll 101 is covered by a vacuum box 105 connected to a vacuum pump (not shown) effective to draw moisture from the ribbon 109 discharged on the endless belt 104 via a headbox 108.

Forming foils 111 are arranged to drain into a tray (not shown) to feed a fan pump (not shown) in a typical way. A pair of press rolls 114 and 115 are provided to compress the ribbon 109 as it passes between the suction roll 101 and the press rolls 114 and 115. The press rolls 114 and 115 may be disposed within a hood (not shown).

A top mesh 117 provided in the form of an endless flexible member may have forming foils 118 in a typical arrangement to help form a sheet from ribbon 109. Top mesh 117 may cooperate with belt 104 around about two-thirds of peripheral surface 102 of the suction roll 101. The return run of mesh 117 may be supported on any convenient number of rolls such as 119, 120, 121, 122 and 123, the latter being a second suction roll.

Ribbon 109 has an exit as a dried sheet 124 at the roll 137 disposed at the point of divergence of belt 104 and mesh 117, this point being also the start of the return circuits of belt 104 and mesh 117.

Suction roll 101 has hood 116 and 116A in sliding sealing contact therewith. The second stage suction roll 123 may have a hood 116*b*. The suction roll 123 has an external suction box 138 for drawing moisture from ribbon 109 to a vacuum pump (not shown). Ribbon 109 has a transfer from suction rolls 101 to 123 with the support of belt 104 at one surface and the support of mesh 117 at the other surface thereby avoiding stress on ribbon 109 in the transfer. Moisture has a movement in one direction through ribbon 109 at suction roll 101 and has a movement in an opposite direction through ribbon 109 at suction roll 123. Suction roll 123 is in effect an extension of the porous peripheral surface 102 of suction roll 101, both rolls being in register.

For minimal shadow marking at a suction roll, the drill holes of roll 101 may be registered a half pitch from the drill holes of suction roll 123.

The same type of heat cycle may be applied for the apparatus of FIG. 2 as for the apparatus of FIG. 1 with similar benefits of small space, low capital and operating costs, etc.

Some paper grades can benefit by being stretched in the manufacturing process, i.e. by draws which this invention avoids, the paper width decreasing while the length is increasing. Such stretching helps to avoid cockle when the paper comes to be used as in a print shop. Nevertheless, by forming and drying on a single surface as described hereinbefore, the fibre bonds and sheet dimensions are advantageously retained, thereby providing good paper strength. This is important for many paper grades such as bag and sack papers as well as currency and security papers.

The above embodiments are adapted to regain the qualities of hand made sheets, qualities partly lost in machine made sheets of prior art.

Pin holes in a sheet can result sometimes from strong vacuum on a thin sheet, such as tissue and toweling, a benefit for absorbency in paper usage. However, pin holes would be a defect for print paper, a matter controlled by varying machine speed, mesh count, sheet thickness, fibre quality, vacuum strength, temperature, etc. Dwell time at vacuum is proportional to machine speed and roll diameter.

Various forming variations are contemplated. For instance, the pulp stock delivery may be at any vertical angle. A liquid delivery may be replaced by a formed sheet delivery.

The forming fabric, i.e. belts 4, 17, 104 and 117, may vary greatly in mesh count, especially varying toward a much finer weave than in prior art, to retain fines, because this invention avoids the strong pull of a fourdrinier and avoids the strong pull of a roll former.

Various pressing variations are also contemplated. Indeed, pressing in this invention may have the use of felts (not shown), a caution being that this forming fabric enters the press nip, affecting allowable nip pressure.

The optional outer porous belt 17, 117 also may enter the press nip, but need not, as the outer porous belt 17, 117 may vary in having any wrap length on the suction zone such as having an exit before or after a nip.

Belt marking is a risk in a press, lessened in the present invention because the mesh tension is low, permitting a variation of weave toward the very fine, avoiding coarse humps and hollows at the mesh. A fine mesh lessens a tendency for fibres to lock into mesh pores and helps to retain fines.

Varying the nip pressure would vary the sheet rebound after nip compression. Rebound lets pores expand, in bellows fashion, drawing back some moisture just expressed from the sheet. Some springiness is inherent in a sheet, rebound after a nip therefore unavoidable, so this invention overcomes that type of rewetting by having an extended suction zone integral with the nip.

In trying to vary the nip compression and subsequent rebound it is important to note that capillary action is tenacious. Pressure from surface tension in a water drop increases as the drop size decreases. In a water drop one hundredth of a millimeter in dia. the pressure amounts to 150 $g/cm^2$(2.1 $lb/in^2$). A preferred vacuum in this suction roll is about two-thirds of an atmosphere (20" Hg) i.e. $\frac{2}{3}\times 14.7$ $lb./in^2$–9.8 $lb./in^2$. In this invention the pressure differential therefore is a good deterrent against sheet rewetting from rebound.

Because heat lowers the surface tension, the heat may be varied for best effect, dependent on variances in nip pressure, fibre resiliency in rebound after the nip, sheet thickness, sheet porosity, speed, etc.

Varying the nip pressure to light loading for minimal belt marking, even with a shoe press, is compensated by an extended suction zone integral with the nip in this invention. This extended nip zone also is free from a centrifugal throw of moisture because the centrifugal flow is into the vacuum box 5, 105 not toward the ribbon 9, 109.

Drying in this invention is preferred with a known high-velocity hood 16, 116 and this may be in sections, if desired, located at any or all of forming, pressing and drying. As explained hereinbefore, a preferred construction has positive pressure in the hood 16, 116 in order to have a slightly higher than atmospheric boiling temperature and to have a pressure on the top surface of the ribbon 9, 109 to augment suction force on the bottom surface of the sheet. Such a hood 16, 116 could be called a pressure cap.

Pressure in the hood 16, 116 requires sliding seals at the juncture of hood 16, 116 and suction roll 1, 101. A differential pressure through the ribbon 9, 109 may be varied, by changing pressures at the top and bottom of the ribbon 9, 109, to suit various paper grades, speeds, etc. It is important to note that the heat may penetrate the ribbon 9, 109 pores continuously, without pulses, lowering surface tension in the ribbon 9, 109 to aid moisture removal.

The return part of the heat cycle illustrated in FIG. 1 also may be varied. For example, condensate may return to a wire pit, the vacuum pumps 27 and 28 may be multi stage and preferably as a blower with intermediate bleed of condensate instead of the two pumps 27 and 28 shown. A multi stage pump would have atmospheric pressure at a stage inside the pump in the change from negative to positive pressure.

Furthermore, as mentioned hereinbefore, the return part of the heat cycle may have further heat added via the heating coil C after vapor expansion when higher temperature is wanted. Another variation would be to add different amounts of heat to each of the hood sections 16*a*, 16*b* and 16*c*.

This invention has a preferred use for making paper but may have other uses. One use would be as a felt conditioner to wash additives, fillers and loose fibres from felts and to dry felts.

Another use would be to produce a pulp sheet, needing less precision of formation than paper, and less precision of moisture and surface tolerances than paper.

A further use would be to wash pulp, i.e. to wash out chemicals, liquors, ink particles, clay, fillers, etc. from pulp.

A still further use would be textile cleaning, rinsing, sizing, drying, etc.

More uses would be the cleaning and drying of powders, seeds, granular material, foods, mashes, sludges and materials in flexible sheet form.

It is known that surface tension between fibres resists the blowing of moisture from a sheet. However, drying by blowing is time sensitive, seen commonly with laundry. Given enough time, any fibres will dry from blowing, needing minutes with laundry but having only part of a second available with papermaking speeds. Yet, moisture inside textile fibres does eventually dry out, paper fibres being shorter.

Therefore, a relatively long blowing time is suitable to effect efficient drying of paper fibres. Accordingly, the above-described apparatuses have been advantageously designed to provide sustained suction. However, surface tension still imposes a limit on the drying achievable with this long suction zone. To extend the limit, superheated vapor is used so as to weaken the surface tension between fibres thereby to speed drainage. In addition, the heat is above the boiling point of 212 deg. F. (100 deg. C.), the ribbon 9, 109 at the suction roll 1, 101 having a hood 16, 116 slightly pressurized above atmospheric. The superheated vapor also has some moisture absorbency to aid drying at the sheet pores.

A limited time at the long suction zone, with paper machine speeds, requires that fibres having moisture inside be flattened somewhat by pressing. Just as in sheet pores before a nip, heat speeds removal of moisture after a nip, the suction zone extending beyond and integral with the nip. There is no lapse of suction force, no centrifugal throw, no chance for moisture to migrate backward.

Another advantage of the present invention resides in the fact that moisture is forced relentlessly from top to bottom of the ribbon 9, 109, thereby allowing to have a more compact apparatus permitting superheated vapor to replace air use.

Furthermore, as the apparatus is relatively small, the vacuum pumps 27 and 28 may be used as heat pumps.

This, in turn, permits the use of superheated vapor, airless except for leakage, all the vapor being confined in piping and the high velocity hood 16, 116. Vapor compression and expansion becomes the basis of operation. Energy needed for returning heat in a closed cycle comes, in this invention, from the vacuum pump motor. This is in preference to adding fuel at a steam plant.

The commonest example of a heat pump is a kitchen refrigerator. If considered as cooling the food it is classed as a refrigerator. If considered as heating the room it is classed as a heat pump.

Whenever steam is formed, it has the same temperature as the water from which it formed and condensation is the reverse. A heat pump is the reverse of a heat engine. No operation of a heat engine, or heat pump, is more efficient than a reversible cycle.

A mechanical reversible cycle such as a crank has 100% efficiency less some friction. However, a heat cycle cannot exceed the efficiency of a Carnot cycle. This is because heat will flow from warm to cool and not the reverse. It follows that the Carnot cycle, as applied to heat pumps, would give the best theoretical efficiency. It is well to note that the Carnot cycle is based on a piston acting in the cylinder of an engine.

The efficiency of the Carnot cycle is expressed by the formula:

$$et = \frac{Q1 - Q2}{Q1} \text{ or } et = \frac{T1 - T2}{T1}$$

where et=efficiency, theoretical

T1=abs. temp. of heat supplied Q1

T2=abs. temp. of heat discharged Q2

Considering the Carnot cycle in reverse, as would apply to a heat pump, one has the reciprocal as:

$$etR = \frac{T1}{T1 - T2}$$

where

T1=abs. temp. of inlet gas

T2=abs. temp. of exit gas

Since et is always less than unity, etR is always more than one. Instead of the term efficiency being used, the etR is termed Coefficient of Performance (COP). To obtain a high COP the temp. through which the vapor is raised should be small.

A preferred pressure in the return part of the cycle is about two atmospheres gage, corresponding to about 275 deg. F. (135 deg. C.), for saturated vapor. A preferred pressure in the hood 16, 116 is about one-third of an atmosphere gage, corresponding to about 228 deg. F. (108 deg. C.), for saturated vapor. At the ribbon 9, 109, the superheated vapor quickly becomes saturated in penetrating the ribbon 9, 109 pores.

With positive pressure at the top side of the ribbon 9, 109 and negative pressure under the ribbon 9, 109, atmospheric pressure is reached within the ribbon 9, 109. At the atmospheric stratum in the ribbon 9, 109, the flash point would be 212 deg. F. (100 deg. C.). The flash point would drop through the ribbon 9, 109 and reach a low limit at the bottom of the ribbon 9, 109.

However, a boiling temperature is not needed for evaporation, seen after a rain and with our bodies.

The two atmospheres gage pressure is preferred, on the saturated vapor, in order to form some condensate which is extracted and sent back to the incoming pulp. The two atmospheres pressure also is to provide for a pressure gradient in the return part of the heat cycle where the gradient is an expansion transforming the pressurized saturated vapor into superheated vapor at a lowered pressure and temperature.

This transformation has three main effects. Firstly, the superheated vapor has a moisture absorbing capacity at the ribbon 9, 109. Secondly, the heat weakens surface tension at the ribbon 9, 109. Thirdly, the superheated vapor is hotter than the flash point at the ribbon 9, 109. Each of these three effects is an aid for speedy drying thereby enabling compact apparatus.

Other pressures and temperatures may be chosen. This above-described heat cycle has the suction roll pores or holes 3, 103 evacuated for a full turn, yielding basic differences in operation. Important differences are that the resultant sustained evacuation of holes 3, 103 makes possible a recycling of vapor in sheet drying, a speedy drying and a compact apparatus. These differences permit having low capital cost and low operating cost.

What is claimed is:

1. An apparatus for making a web of paper, comprising a first hollow rotatable cylinder having a porous peripheral surface upon which a web of paper is formed, pressed and dried, a first porous endless conveying member in drive engagement with said porous peripheral surface for conveying incoming pulp material over said first hollow cylinder, at least one press roll for pressing a web of pulp material against said first hollow cylinder as said web travels thereover, and an airless drying medium circulating system for drawing moisture from the web, said airless drying medium circulating system comprising a hooded section connected to a source of vacuum and disposed in airtight engagement with a portion of said porous peripheral surface of said first hollow rotatable cylinder so as to cause a flow of moisture from the web, through said first porous endless conveying member and said porous peripheral surface, into said first hollow cylinder and out of said first hollow cylinder through said hooded section.

2. An apparatus as defined in claim 1, wherein the moisture is extracted from the web as a mixture of liquid and vapor, and wherein said drying medium circulating system comprises primary separating means connected to said vacuum hooded section for separating the vapor from the liquid of the moisture extracted from the web, compressing means for compressing the vapor to form condensate and saturated vapor, secondary separating means for separating said condensate from said saturated vapor, expansion means adapted to expand saturated vapor to form superheated vapor, and means for directing said superheated vapor to a hood placed in airtight engagement with a portion of said hollow cylinder to direct the superheated vapor to the web passing on the first hollow cylinder.

3. An apparatus as defined in claim 1, further comprising a second hollow cylinder disposed for receiving the web from said first hollow cylinder, said second hollow cylinder being in drive engagement with a second porous endless conveying member, said first hollow cylinder being disposed within a loop formed by said first porous endless conveying member and outside a loop formed by said second porous endless conveying member, while said second hollow cylinder being disposed within the loop formed by said second endless member and outside the loop formed by said first porous endless conveying member, said first and second porous endless conveying members defining an entry at a point of convergence thereof upstream of said first hollow cylinder and an exit at a point of divergence thereof downstream of said second hollow cylinder, whereby the web is supported between said first and second porous endless conveying members as it passes from the first hollow cylinder to the second hollow cylinder.

4. A compact apparatus for producing a continuous web of paper, comprising a hollow cylinder having a porous peripheral surface upon which a paper web is formed, pressed and dried, said hollow cylinder being mounted for rotation about a main axis thereof and having an inlet for receiving a fibrous material carried on a porous endless conveying member extending over said hollow cylinder, pressing means positioned downstream of said inlet for compressing the fibrous material against said porous peripheral surface of said hollow cylinder as the material is conveyed thereover by said porous endless conveying member, and a drying medium circulating system for uninterruptedly drawing moisture from the material even when the same is being compressed by said pressing means, said drying medium circulating system comprising a vacuum hooded section disposed for collecting the moisture at a portion of said porous peripheral surface of said hollow cylinder which is free from engagement with said porous endless conveying member.

5. A compact apparatus as defined in claim 4, wherein the moisture is extracted from the fibrous material as a mixture of liquid and vapor, and wherein said drying medium circulating system comprises primary separating means connected to said vacuum hooded section for separating the vapor from the liquid of the moisture extracted from the fibrous material, compressing means for compressing the vapor to form condensate and saturated vapor, secondary separating means for separating said condensate from said saturated vapor, expansion means adapted to expand saturated vapor to form superheated vapor, and means for directing said superheated vapor to the fibrous material passing on the hollow cylinder.

6. A compact apparatus as defined in claim 5, wherein said means for directing said superheated vapor to the fibrous material passing on the hollow cylinder include hood means disposed in sliding sealing engagement with said hollow cylinder, whereby the moisture extracted from the fibrous material is recirculated in a closed substantially air impervious system to be used again in the drying of the fibrous material.

7. A compact apparatus as defined in claim 6, wherein said pressing means is disposed within said hood means.

8. A compact apparatus as defined in claim 5, wherein said compressing means include at least two stages of compression.

9. A compact apparatus as defined in claim 5, wherein said secondary separating means is disposed between the stages of said compressing means, and wherein a tertiary separating means is disposed downstream of said compressing means.

10. A compact apparatus as defined in claim 9, wherein the liquid extracted by said primary separating means and the condensate extracted by said secondary and tertiary separating means are returned to a source of the fibrous material.

11. A compact apparatus as defined in claim 4, wherein said vacuum hooded section is located outside of said hollow cylinder within a loop formed by said porous endless conveying member about said hollow cylinder.

* * * * *